US011982467B2

(12) United States Patent
Jette

(10) Patent No.: US 11,982,467 B2
(45) Date of Patent: May 14, 2024

(54) RAISED FLOOR AIR SANITIZATION SYSTEM

(71) Applicant: Cable Management Solutions Inc., Bayshore, NY (US)

(72) Inventor: Roger Jette, East Islip, NY (US)

(73) Assignee: CABLE MANAGEMENT SOLUTIONS INC., Bayshore, NY (US)

( * ) Notice: Subject to any disclaimer, the term of this patent is extended or adjusted under 35 U.S.C. 154(b) by 311 days.

(21) Appl. No.: 17/146,844

(22) Filed: Jan. 12, 2021

(65) Prior Publication Data

US 2022/0221174 A1 Jul. 14, 2022

(51) Int. Cl.

| | |
|---|---|
| ***F24F 8/22*** | (2021.01) |
| ***E04F 15/024*** | (2006.01) |
| ***F24F 3/167*** | (2021.01) |

(52) U.S. Cl.

CPC ..... *F24F 8/22* (2021.01); *E04F 15/02447* (2013.01); *F24F 3/167* (2021.01)

(58) Field of Classification Search

CPC ..... E04F 15/024; E04F 15/02447; E04F 15/02405; E04F 15/02417; E04B 5/48; F24F 3/16; F24F 3/167; F24F 3/163; F24F 8/22; A61L 9/18; A61L 9/20; B01D 53/007

See application file for complete search history.

(56) References Cited

U.S. PATENT DOCUMENTS

| | | | | |
|---|---|---|---|---|
| 4,210,429 A * | 7/1980 | Golstein | ..... | A61L 9/20 55/473 |
| 5,225,167 A * | 7/1993 | Wetzel | ..... | F24F 7/013 250/492.1 |
| 7,582,256 B1 * | 9/2009 | Geron | ..... | B01D 53/885 422/4 |
| 9,522,210 B2 | 12/2016 | Worrilow | | |

(Continued)

FOREIGN PATENT DOCUMENTS

| | | | | |
|---|---|---|---|---|
| CN | 2555474 Y | 6/2003 | | |
| DE | 202020002459 U1 * | 8/2020 | ..... | F24F 8/22 |

(Continued)

OTHER PUBLICATIONS

AirPurifiersandCleaners.com "Sanitaire RS140 Commercial UV Room Air Sanitizer System" accessed on Apr. 2, 2021, https://www.airpurifiersandcleaners.com/atlantic-uv-sanitaire-rs140-uv-room-sanitizer, pp. 1-2.

*Primary Examiner* — Kyle J. Walraed-Sullivan
(74) *Attorney, Agent, or Firm* — CARTER, DELUCA & FARRELL LLP

(57) ABSTRACT

A raised floor system includes a plurality of base units and at least one sanitizer unit. The plurality of base units are configured to define a portion of a floor. The sanitizer unit is configured to provide sanitized air to an environment above the floor. The sanitizer unit includes a housing; an ultraviolet light source disposed in the housing; a fan configured to facilitate air to flow into the housing, across the ultraviolet light source, and out of the housing into the environment; and a cover plate disposed on the housing, the cover plate configured to define a portion of the floor and to allow air to exit the housing into the environment.

12 Claims, 5 Drawing Sheets

(56) References Cited

U.S. PATENT DOCUMENTS

2006/0000360 A1* 1/2006 Shou ..... F24F 8/192
422/121
2006/0213157 A1* 9/2006 Kalous ..... F24F 8/158
55/385.2
2010/0058685 A1* 3/2010 Bousseton ..... E04F 15/024
52/220.1
2010/0202932 A1* 8/2010 Danville ..... A61L 9/205
422/121
2011/0232481 A1* 9/2011 Worrilow ..... B01J 20/165
95/10
2012/0283508 A1* 11/2012 Worrilow ..... F24F 11/52
252/372
2012/0285459 A1* 11/2012 Sata ..... F24F 8/80
128/205.27
2018/0153367 A1* 6/2018 Dombrowsky ..... H05B 47/115
2019/0125917 A1* 5/2019 Kim ..... B01D 53/885
2019/0240370 A1* 8/2019 Benedek ..... B01D 53/007
2019/0277522 A1* 9/2019 Soyyigit ..... F24F 11/89
2020/0061231 A1* 2/2020 Jeong ..... B01D 46/46
2021/0128774 A1* 5/2021 Maa ..... B01J 35/004
2021/0283296 A1* 9/2021 Liang ..... B01D 53/82
2021/0315749 A1* 10/2021 Uda ..... A61G 3/008
2021/0386901 A1* 12/2021 Shalvi ..... A61L 9/20
2022/0008601 A1* 1/2022 Wang ..... B01D 46/2411
2022/0026085 A1* 1/2022 Kim ..... F24F 8/80
2022/0047757 A1* 2/2022 Maa ..... A61L 9/205
2022/0049862 A1* 2/2022 Derwinski ..... B66B 11/024
2022/0111084 A1* 4/2022 Lan ..... A61L 9/20
2022/0120458 A1* 4/2022 Lee ..... A61L 9/20
2022/0186954 A1* 6/2022 Ma ..... F24F 8/30
2022/0249729 A1* 8/2022 Hill ..... F21S 8/02
2022/0357066 A1* 11/2022 Drew ..... G05B 19/042
2022/0395606 A1* 12/2022 Sun ..... A61L 9/20
2022/0410050 A1* 12/2022 Jones ..... B01D 46/0028

FOREIGN PATENT DOCUMENTS

JP 2002039593 A 2/2002
WO 2019045777 A1 3/2019

* cited by examiner

RAISED FLOOR AIR SANITIZATION SYSTEM

BACKGROUND

Technical Field

The present disclosure relates to raised floor systems and, more particularly, to a raised floor system including air sanitizing devices.

Description of Related Art

Many air sanitizing systems exist that maintain air purity and sanitization, and often use ultraviolet light to destroy pathogens in the air. Commercial buildings, which generally have higher foot traffic and therefore greater exposure to pathogens, often incorporate sanitization systems such as HEPA filters into their ventilation systems. However, the filters are often placed away from the air or ventilation inlets and outlets, limiting the effectiveness of cleaning the air at the site of higher foot traffic or populated working environments (e.g., open office floor plans).

SUMMARY

To the extent consistent, any of the aspects detailed herein may be used in conjunction with any or all of the other aspects detailed herein.

This disclosure relates to a raised floor system that includes a plurality of base units and at least one sanitizer unit. The plurality of base units are configured to define a portion of a floor. The sanitizer unit is configured to provide sanitized air to an environment above the floor. The sanitizer unit includes a housing; an ultraviolet light source disposed in the housing; a fan configured to facilitate air to flow into the housing, across the ultraviolet light source, and out of the housing into the environment; and a cover plate disposed on the housing, the cover plate configured to define a portion of the floor and to allow air to exit the housing into the environment.

In aspects, the floor may be configured to support floor loads from about 10 pounds per square foot (lbs/ft$^2$) to 50,000 lbs/ft$^2$.

In other aspects, each base unit and the sanitizer unit may be configured to support floor loads from about 10 pounds per square foot (lbs/ft$^2$) to 50,000 lbs/ft$^2$.

In some aspects, the plurality of base units and the at least one sanitizer unit may be spaced-apart to define channels therebetween.

In additional aspects, the raised floor system may include a channel plate configured to cover at least one of the channels, the channel plates supported by the base units or sanitizer unit.

In yet other aspects, the sanitizer unit and plurality of base units are configured to be modularly re-arranged between a first configuration and a second configuration.

In aspects, the housing of the sanitizer unit may include an inlet along a wall of the housing to permit air flowing between the sanitizer units and the plurality of base units to enter the sanitizer unit.

In alternative aspects, the housing of the sanitizer unit, when covered by the cover plate, may cooperate with the base units to define an approximately level plane along top surfaces thereof.

In more aspects, the ultraviolet light source may include an ultraviolet bulb or an ultraviolet light emitting diode.

This disclosure also provides a raised floor system that includes a plurality of pedestals, a plurality of floor tiles, and at least one sanitizer unit. Each floor tile is supported by at least one pedestal of the plurality of pedestals. The plurality of floor tiles define a portion of a floor thereabove and a plenum therebelow. The sanitizer unit is configured to provide sanitized air to an environment above the floor. The sanitizer unit includes a housing; an ultraviolet light source disposed in the housing and configured; a fan configured to cause air to flow into the housing and exit the housing into the environment; and an end plate disposed on the housing, the end plate configured to allow air to exit the housing into the environment. One of the floor tiles is configured to receive the sanitizer unit therethrough such that the end plate of the sanitizer unit is approximately level with a top of the floor tile.

In aspects, the floor may be configured to support floor loads from about 10 lbs/ft$^2$ to 50,000 lbs/ft$^2$.

In other aspects, the plurality of pedestals, plurality of floor plates, and the at least one sanitizer unit may be configured to be modularly re-arranged between a first configuration and a second configuration.

In some aspects, the housing of the sanitizer unit may include an inlet along a bottom portion of the housing to permit air flowing in the plenum to enter the sanitizer unit, flow through the housing of the sanitizer unit, and exit out the end plate of the sanitizer unit (for example, due to a static pressure differential between the plenum and an environment above the sanitizer unit).

In aspects, the housing may be a hollow tube, the ultraviolet light source may be oriented vertically within the hollow tube, and the fan may be coupled to an end of the hollow tube. In aspects, the fan urges air to flow through the hollow tube or air flows through the hollow tube due to a pressure differential between the plenum and an environment above the sanitizer unit.

Another aspect of this disclosure provides an air sanitizer unit for a raised floor system. The air sanitizer unit includes a housing configured to integrate with a modular raised floor system defining a floor. The housing includes a cover configured to be approximately level with a top surface of the raised floor system. An ultraviolet light source is disposed in the housing. The air sanitizer unit includes a fan configured to cause air to flow into the housing, across the ultraviolet light source, and exit the housing into an environment above the floor.

In aspects, the housing may approximate a base unit of a raised floor system and may be configured to replace a base unit of the raised floor system.

In other aspects, the fan may be configured to pull air flowing between base units of the raised floor system or pull air from the environment above the raised floor system and cause the air to flow out of the housing and into the environment above the raised floor system.

In additional aspects, the cover may include a first grate at a first end portion thereof and a second grate at a second portion thereof, wherein the fan is configured to pull air into the housing through either the first grate or second grate and the other of the first grate or second grate.

In yet other aspects, the cover may include a first grate at a first end portion thereof and a second grate at a second end portion thereof, the ultraviolet light source disposed in the housing between the first and second grates.

In yet further aspects, the sanitizer unit may further include a floor tile configured to receive the housing, the floor tile configured to replace a standard floor tile of a raised floor system.

In an aspect, the housing may be configured to be suspended by a floor tile of a raised floor system such that the air sanitizer unit does not interfere with a top surface of the floor tile.

BRIEF DESCRIPTION OF THE DRAWINGS

The above and other aspects and features of the present disclosure will become more apparent in view of the following detailed description when taken in conjunction with the accompanying drawings wherein like reference numerals identify similar or identical elements.

DETAILED DESCRIPTION

Figure 1:
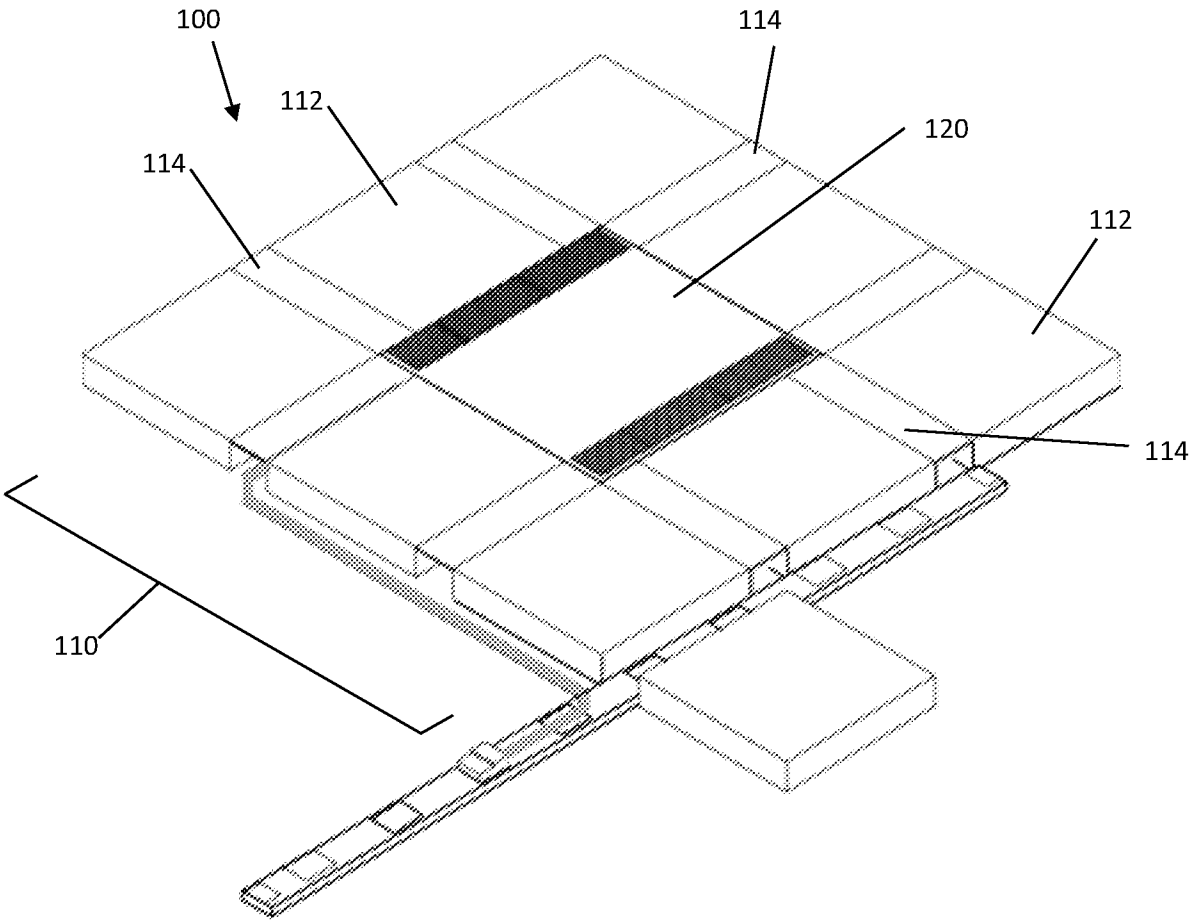
FIG. 1 is a perspective view of one illustrative aspect of a raised floor air sanitization system in accordance with aspects of this disclosure.

With reference to FIG. 1, a raised floor air sanitization system 100 for providing cable management, air handling, and air sanitization is illustrated. The raised floor air sanitization system includes a plurality of floor base units 110, one or more sanitizer base units 120, and one or more channel plates 114.

The plurality of floor base units 110 may include any number of floor base units 112 arranged in any desirable manner (e.g., a square grid) to meet the needs of the location of the raised floor air sanitization system 100. The raised floor air sanitization system 100 may be at least partially covered by traditional flooring (not shown) such as, but not limited to, vinyl tiles, carpet, carpet tiles, linoleum, laminate flooring, rubber tiles, wood, stone, and ceramic tiles.

Each base unit 112 generally defines a box-like structure and is configured to withstand floor loads when installed (e.g., 10 pounds per square foot (lbs/ft$^2$) to 200 lbs/ft$^2$, or load ratings from 100 lbs to 50.00 lbs). In aspects, the box-like structure may be a podium. Base units 112 may be of any shape or size, such as, but not limited to, polygons, cylinders, or triangular-box structures. The base units 112 may be made of any suitable material for withstanding floor loads, such as metal, high strength plastic, combinations thereof, etc. Channel plate 114 is similarly configured to withstand floor loads and may be made of the same or different material(s) as the base units 112.

The raised floor air sanitization system 100 is configured to define channels 102 (see FIG. 4A) between the floor base units 112 and/or the one or more sanitizer base units 120, wherein the channels 102 enable the passage and organization of power cables, networking cables, etc. In aspects, the channels may be used for room air circulation and/or ventilation. Channel plates 114 are positioned to cover or span the channels 102 or other gaps between adjacent base units 112, between a base unit 112 adjacent a sanitizer base unit 120, between adjacent sanitizer base units 120, and/or between a base unit 112 or sanitizer base unit 120 and a wall or other structure. Channel plates 114 may be supported by edges of the sanitizer base units 120 or a base unit 112. Channels 102 are configured to receive cables, pipes, vents, or the like.

Figure 2:
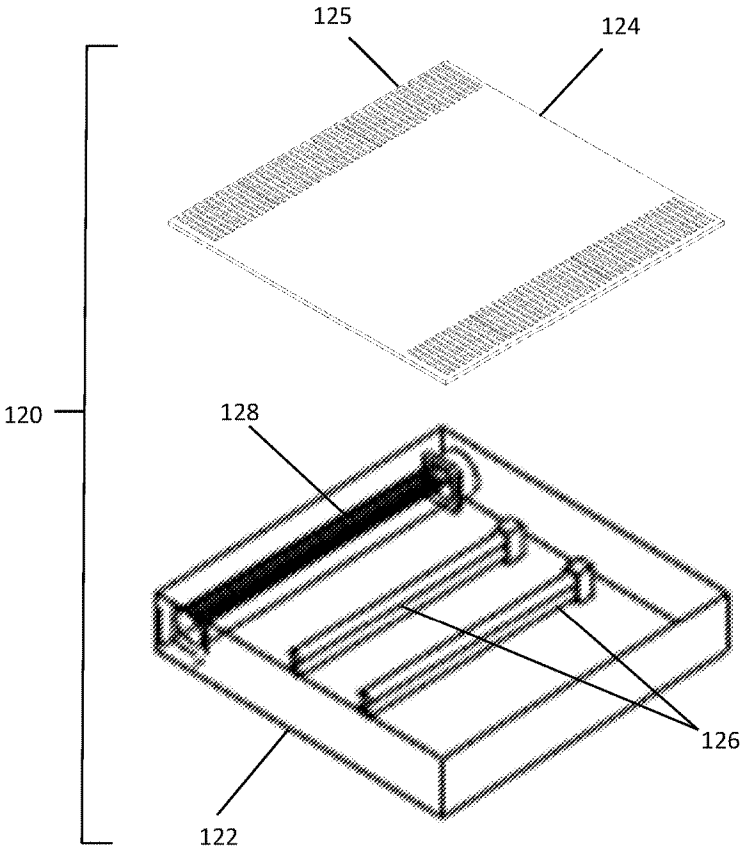
FIG. 2 is an enlarged, perspective, partially exploded view of a sanitizer base unit configured for use with the raised floor air sanitization system of FIG. 1 or any other suitable raised floor air sanitization system.

With reference to FIG. 2, the sanitizer base unit 120 of the raised floor air sanitization system 100 includes a housing 122, a cover plate 124, and one or more ultraviolet (UV) light sources 126 disposed in the housing 122. In aspects, the sanitizer base unit 120 includes a fan 128 also disposed in the housing 122. The sanitizer base unit 120 is configured to supply the environment above the raised floor air sanitizer system 100 with sanitized air.

The cover plate 124 is configured to removably couple to the housing 122. The cover plate 124 and housing 122 are configured to withstand floor loads (e.g., commercial floor loads of a mall or office building), such that, together with the plurality of base units 110 and channel plates 114, the raised floor air sanitization system 100 is able to withstand floor loads.

The cover plate 124 includes one or more grates 125 to allow air to pass through the sanitizer base unit 120. The grates 125 may cover 1% to 99% of a surface area of the cover plate 124. In aspects, the grates 125 are positioned such that they are not directly over the UV light source 126 to limit UV light from traveling directly into the environment. In aspects, the grates 125 cover 1% to 25% of the surface area of the cover plate such that the UV light source 126 is located in the housing 122 under the remaining 99% to 75%, respectively, of the surface area of the cover plate such that UV light is not directly emitted into the environment. In aspects, a first grate 125 is disposed on one side of the UV light source 126 and a second grate 125 is disposed on a second, opposite side of the UV light source 126. In such aspects and other aspects, the fan 128 is positioned to direct air from the first grate 125 across the UV light sources 126 to the second grate 125.

The UV light source 126 sanitizes free-flowing air or air pulled into the sanitizer base unit 120 via the fan 128 by emitting UV radiation to destroy or weaken any pathogens, viruses, bacteria, mold, fungi, or other similar harmful organisms or pollutants. The air may be pulled from the environment above the raised floor sanitizing system 100, e.g., through one or more of the grates 125, and/or from the channels 102. The UV light source 126 may be UV bulbs or UV light emitting diodes (UV LEDs). One or more UV light sources 126 may be positioned in the housing 122, such as two UV bulbs or an array of UV LEDs.

Figure 3:
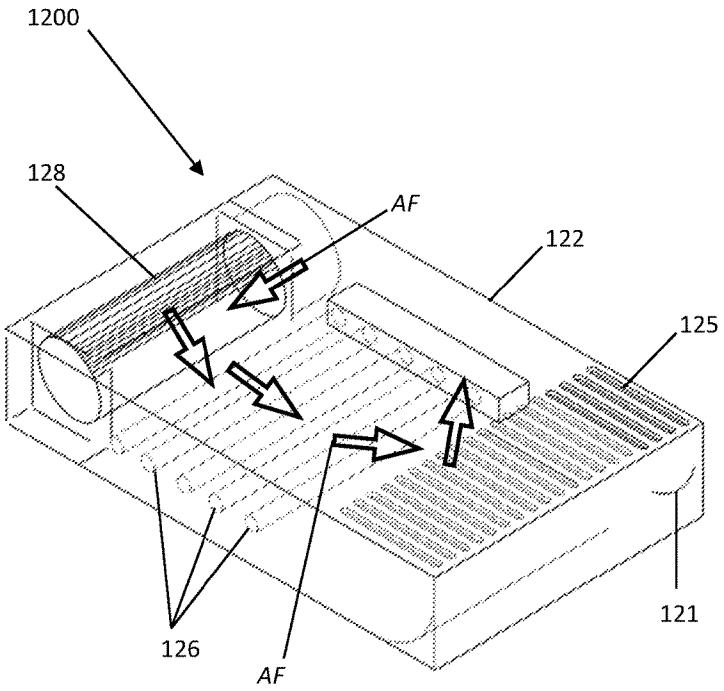
FIG. 3 is a perspective view of another sanitizer base unit configured for use with the raised floor air sanitization system of FIG. 1 or any other suitable raised floor air sanitization system.

With reference to FIG. 3, another sanitizer base unit 1200 is shown including a fan 128 positioned at a first end portion of the housing 122, a plurality of UV light sources 126 disposed and distributed about a middle portion of the housing 122, and a grate 125 at a second end portion of the housing 122. The housing 122 of sanitizer base unit **120*b* includes a curved wall 121 to guide air flowing through the sanitizer base unit 120***b* through the grates 125. As indicated by arrows "AF," air is drawn into the sanitizer base unit 120*b* from an inlet on the side of the housing 122 or alternatively or additionally from a grate disposed above fan 128. The air may be drawn from the channels 102, a plenum space below the raised floor air sanitizer system 100, or the environment above the raised floor air sanitizer system 100. The air exits through the grate 125 and back to the environment to provide sanitized air into the environment above the raised floor air sanitizer system 100.

Figure 4B:
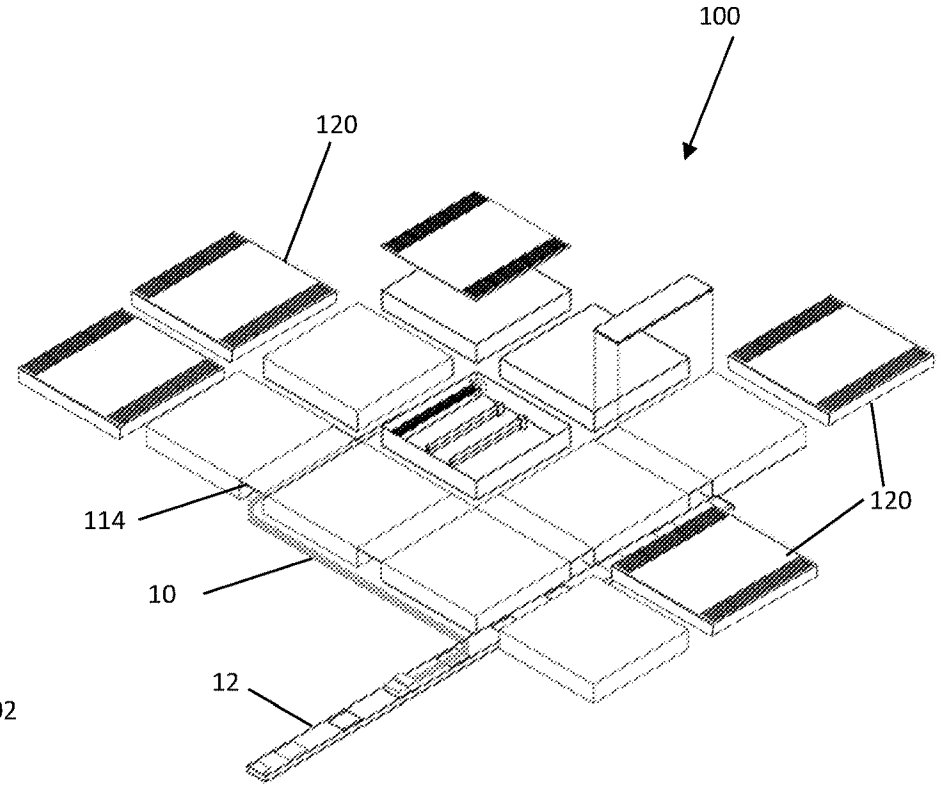
FIGS. 4A and 4B are perspective, exploded views of the raised floor air sanitization system of FIG. 1.
Figure 4A:
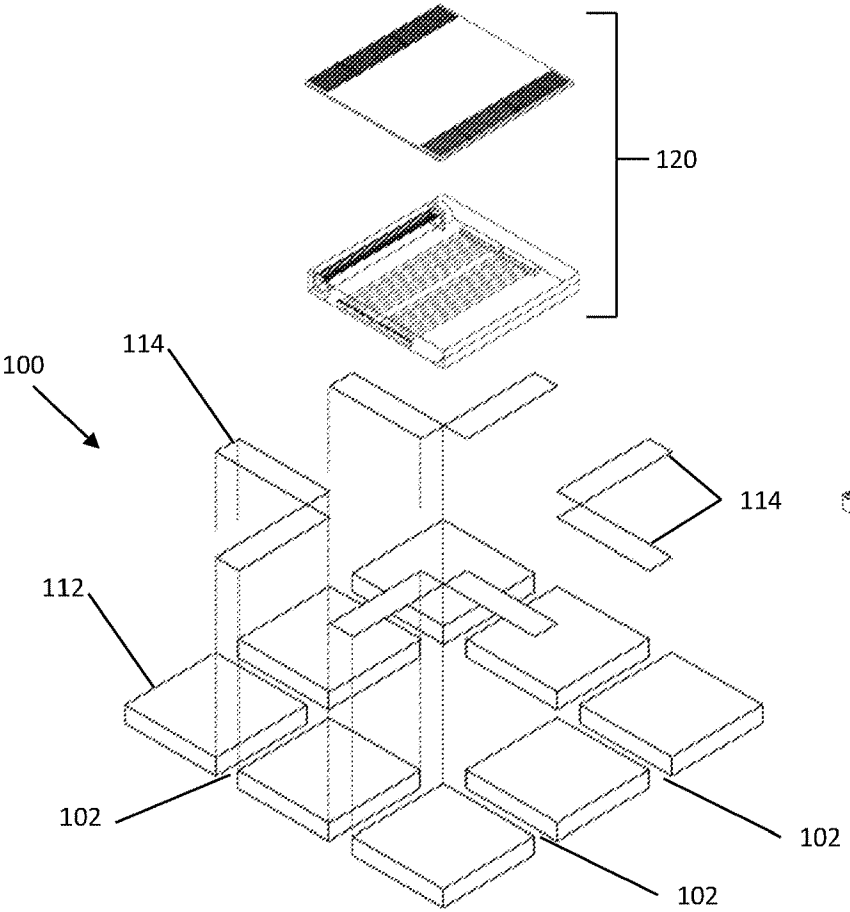

With reference to FIGS. 4A-B, the plurality of base units 110 are arranged in a grid pattern, each base unit 112 spaced apart from an adjacent base unit 112 or sanitizer base unit 120 so as to define channels 102 therebetween. A plurality of sanitizer base units may be arranged adjacent to each other or adjacent to base units 112. The plurality of base units 110 and the one or more sanitizer base units 120 are of approximately the same height so as to provide a level surface across a top plane shared by the plurality of base units 110 and sanitizer base unit 120. In aspects, the plurality of base units 110 and/or one or more sanitizer units 120 may include adjustable legs or walls such that when disposed and distributed over an uneven surface, they plurality of base units 110 and sanitizer units 120 share a common level, top plane. In further aspects, the plurality of base units 110 and one or more sanitizer units 120 may be adjustable to follow inclined surfaces, such as ramps.

The plurality of base units 110 and a plurality of sanitizer base units 120 may be arranged in any suitable configuration. Strategically, multiple sanitizer base units 120 may be positioned in areas of higher traffic or occupancy so as to provide cleaner air in those areas. For example, a server closet with low traffic may have one or two sanitizer base units 120 in the raised floor air sanitizer system 100, but a high traffic, open-floor office plan may have several sanitizer base units 120 positioned between desks or workspaces. The raised floor air sanitizer system 100 is configured to be adaptable to the air sanitizing requirements of any space, building or environment. In aspects, the raised floor air sanitizing system 100 may be easily reconfigured any number of times by redistributing or replacing a base unit 112 for a sanitizer base unit 120 or vice versa. For example, the raised floor air sanitizer system may include a "checkerboard" pattern of base units 112 and sanitizer units 120 or a pattern of three base units 112 between each sanitizer unit 120.

The sanitizer base units 120 are able to be relocated and powered easily, since the raised floor sanitizing system 100 is configured to enable passage of power and networking cables through the channels 102 of the raised floor sanitizing system 100, and power cables can be easily routed through the channels 102 to power the sanitizer base units 120. For example, as illustrated in FIG. 4B, a power cable 10 can be connected to a power strip 12 in electrical communication with a power source (e.g., an outlet or other connection to utility or generator power) and routed to a sanitizer base unit 120 to power the sanitizer base unit 120. In aspects, the sanitizer base units 120 may be integrated into an existing installation of a raised floor system by replacing any base unit 112. The housing 122 and cover plate 124 of the sanitizer base unit 120 may be configured in any shape or structure to mimic a base unit of an existing raised floor system. The sanitizer base unit 120, is configured to be a "plug-and-play" device such that it can be quickly and easily installed in any existing or new raised floor system and powered via power cables routed through the channels of the raised floor system. Thus, the sanitizer base unit 120 may convert an existing raised floor system into a raised floor air sanitizing system 100 of this disclosure.

Figure 6:
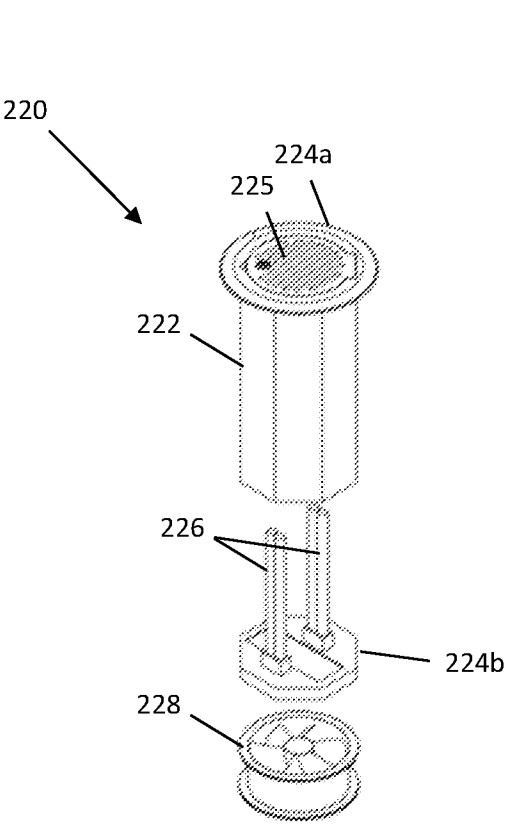
FIG. 6 is an enlarged, perspective, partially exploded view of an air sanitization diffuser for under-floor air distribution (UFAD) of the raised floor air sanitization system of FIG. 5 or any other suitable raised floor air sanitization system.
Figure 5:
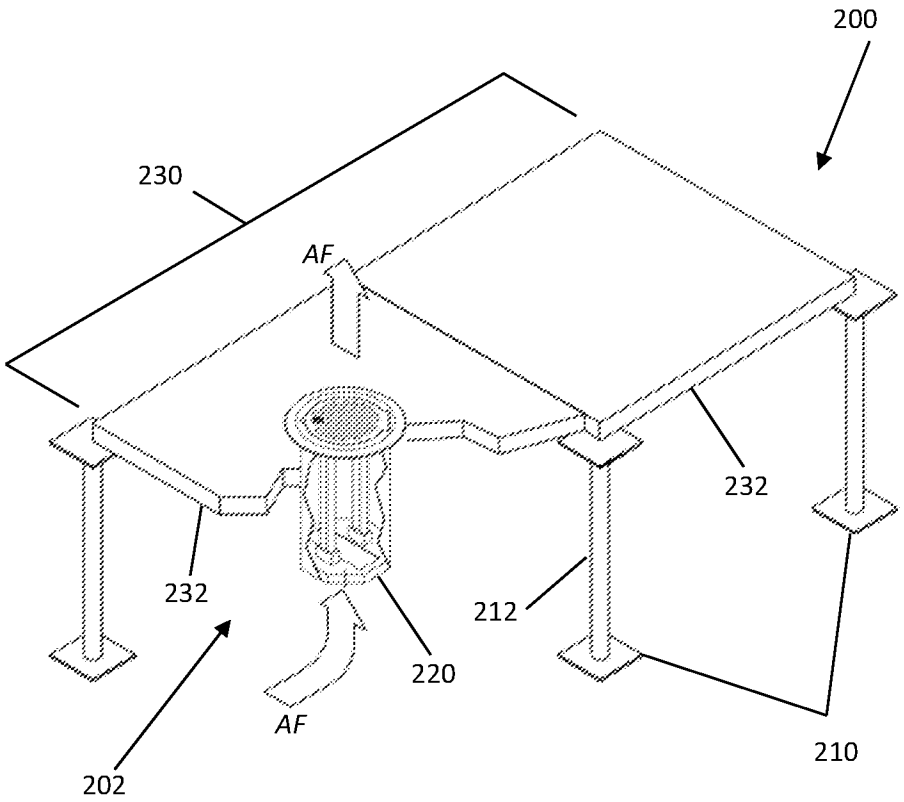
FIG. 5 is a perspective partially cut away view of another illustrative aspect of a raised floor air sanitization system in accordance with aspects of this disclosure.

With reference to FIGS. 5 and 6, another raised floor air sanitizing system 200 provided in accordance with aspects of this disclosure is illustrated, and generally includes a plurality of pedestals 210, sanitizer units 220, and a plurality of floor tiles 230. Raised floor air sanitizing system 200 may be made of a variety of materials and is configured to withstand floor loads. The raised floor air sanitizing system 200 is configured to be arranged in any desirable pattern or grid, similarly, as detailed above with respect to raised floor sanitizing system 100 (FIG. 1). Indeed, to the extent consistent, any of the aspects of raised floor sanitizing system 100 (FIG. 1) detailed herein may be utilized with raised floor sanitizing system 200, and vice versa.

The pedestals 210 operate to elevate floor tiles 230 to define an air handling system such as plenum 202 below. The air handling system (e.g., including plenum 202) enables power and networking cables to be routed under the floor as desired. Additionally, the air handling system (e.g., including plenum 202) provides a space for underfloor air distribution (UFAD), such as forced ventilation, air conditioning, or heating. Each pedestal of the plurality of pedestals 210 may be made of any suitable material, such as metal, plastic, or wood.

Each floor tile 232 of the plurality of floor tiles 230 may be metal (or other suitable) plates supporting traditional flooring or may be traditional floor tiles supported directly by the pedestals 210. The floor tiles 230 may be of any shape or size. At least one floor tile 232 of the plurality of floor tiles 230 is configured to receive a top end of the sanitizer unit 220. The raised floor air sanitizing system 200 may include as many floor tiles 232 configured to receive as many air sanitizer units 220 as desired and arranged in any pattern as desired.

With reference to FIG. 6, sanitizer unit 220 includes a housing 222, end plates 224*a*, 224*b*, and one or more UV light sources 226. In aspects, the sanitizer unit 220 includes a fan 228. Housing 222 may be a tube, a box, or other similar structure, and configured to surround the UV light source(s) 226. The UV light source(s) 226 may be disposed on end plate 224*b* or otherwise positioned vertically, horizontally, or in another suitable manner. End plates 224*a*, 224*b* include one or more slots 225 such that when end plates 224*a*, 224*b*, are coupled to opposite ends of the housing 222, air may flow through end plate 224*b*, into and through the housing 222 where it is sanitized by the UV light source(s) 226 via UV radiation, and out of the end plate 224*a* into the environment above the UV light source(s) 226. In aspects, the plenum space has a higher pressure than a pressure of the environment above the raised floor sanitizing system 200 creating a pressure differential that causes air to flow from the plenum 202, through the air sanitizer unit 220, and into the environment above the raised floor sanitizing system 200. In aspects, a fan 228 urges air to flow through the sanitizer unit 220 in the above-noted manner or other suitable manner and into the environment above the raised floor air sanitizer system 200.

Referring again to FIGS. 5 and 6, the sanitizer unit 220 is received by and couples to the floor tiles 230. End plate 224*a* includes a lip that overlaps a hole in the floor tile 230 such that the floor tile 230 retains the sanitizer unit 220. In aspects, the sanitizer unit 220 is approximately level with a top surface of the floor tile 232 such that it smoothly integrates with the plurality of floor tiles 230 (i.e., does not create an "obstacle" in the floor surface). In aspects, the sanitizer unit is configured to be suspended by a floor tile 232.

Any number of floor tiles 230 with sanitizer units 220 may be used in the raised floor air sanitizer system 200 as similarly discussed above with reference to raised floor air sanitizer system 100 (FIG. 1). Power may be supplied to the sanitizer units 220 from power cables and power outlets disposed or routed through the plenum 202. Sanitizer unit 220 and floor tiles 230 are configured to withstand floor loads when coupled together.

Figure 8:
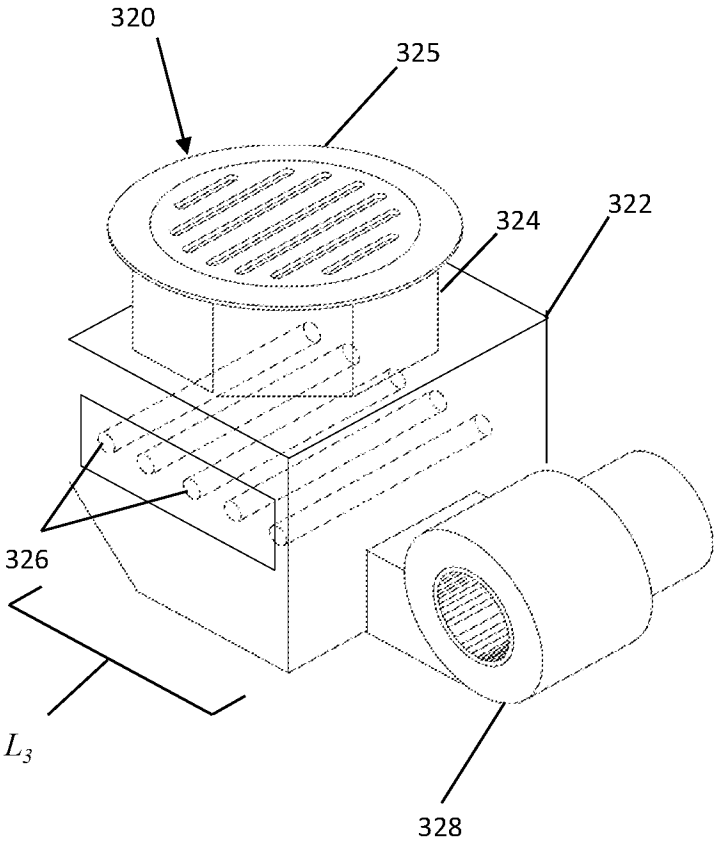
FIG. 8 is an enlarged, perspective view of another air sanitization diffuser for UFAD of the raised floor air sanitization system of FIG. 7 or any other suitable raised floor air sanitization system.
Figure 7:
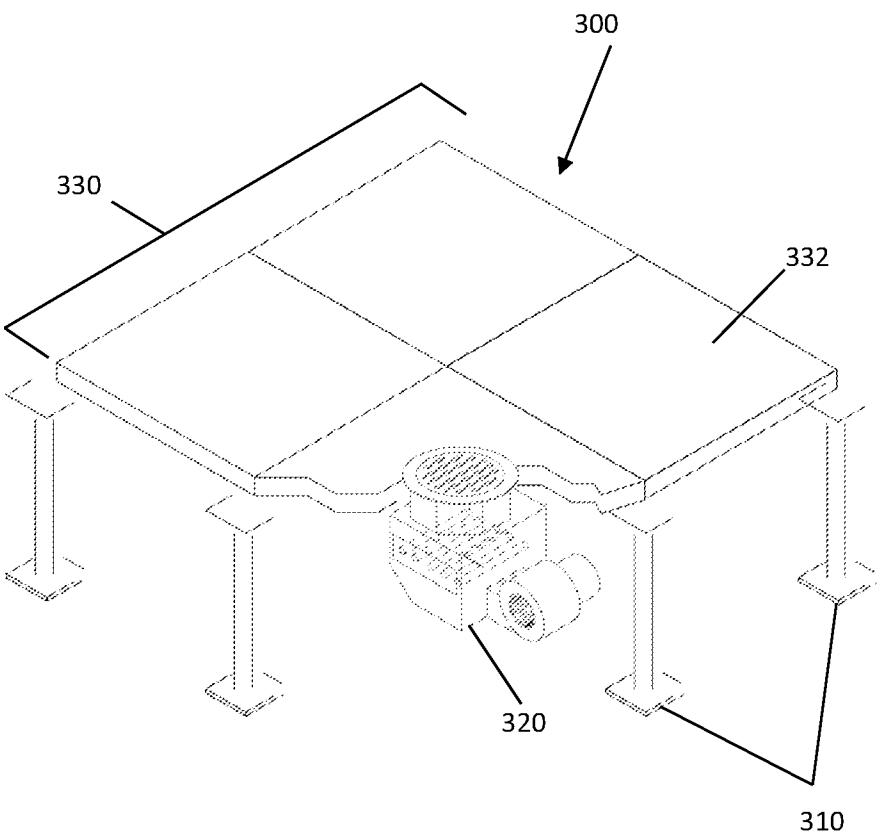
FIG. 7 is a perspective view of still another illustrative aspect of a raised floor air sanitization system in accordance with aspects of this disclosure.

Referring to FIGS. 7 and 8, another raised floor air sanitizing system 300 provided in accordance with aspects of this disclosure is illustrated, and generally includes a plurality of pedestals 310, sanitizer units 320, and a plurality of floor tiles 330. The raised floor air sanitizing system 300 is configured similar to the raised floor air sanitizing system 200 as detailed above. Indeed, to the extent consistent, any of the aspects of raised floor sanitizing system 100 (FIG. 1) or raised floor air sanitizing system 200 (FIG. 5) detailed herein may be utilized with raised floor sanitizing system 300, and vice versa.

Sanitizer units 320 include a housing 322 to hold a plurality of UV light sources 326 (e.g., UV bulbs). Housing 322 includes length L3 such that housing 322 extends parallel to the plurality of floor tiles 330 to include any number of UV light sources 326. For example, as shown in FIG. 8, housing 322 includes a plurality of UV light sources 326 having five UV bulbs. In another example, length L3 may be sufficiently long enough such that the housing 322 may have fifteen UV bulbs disposed therein.

Sanitizer unit 320 includes a fan 328. In aspects, fan 328 is a centrifugal fan. Centrifugal fan 328 provides increased air pressure and a steadier flow of air over the plurality of UV light sources 326 compared with an axial fan. Sanitizer unit 320 includes a shaft 324 with a grate 325 at an end portion thereof configured to support the sanitizer unit 320 on a floor tile 332 and allow sanitizer air to flow from the sanitizer unit 320 into the environment above, as similarly described above with respect to end plate 224*a* of sanitizer unit 220 (FIG. 6).

The phrases "in an aspect," "in aspects," "in various aspects," "in some aspects," or "in other aspects" may each refer to one or more of the same or different aspects in accordance with the present disclosure. A phrase in the form "A or B" means "(A), (B), or (A and B)." A phrase in the form "at least one of A, B, or C" means "(A); (B); (C); (A and B); (A and C); (B and C); or (A, B, and C)."

From the foregoing and with reference to the various figure drawings, those skilled in the art will appreciate that certain modifications can also be made to the present disclosure without departing from the scope of the same. It should be understood that various aspects disclosed herein may be combined in different combinations than the combinations specifically presented in the description and accompanying drawings. While several aspects of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular aspects. Those skilled in the art will envision other modifications within the scope and spirit of the claims appended hereto.

What is claimed is:

1. A raised floor system, comprising:

a plurality of base units positioned to define a raised floor dividing a volume into a plenum below the raised floor and an environment above the raised floor; and at least one sanitizer unit configured to provide sanitized air to the environment, wherein a base unit of the plurality of base units receives the at least one sanitizer unit therethrough, the at least one sanitizer unit including:

a housing defining an inlet disposed within and open to the plenum and an outlet disposed substantially level with the raised floor and open to the environment;

an ultraviolet light source disposed in the housing between the inlet and outlet of the housing;

a fan configured to draw air from the plenum through the inlet of the housing into the housing, move the air across the ultraviolet light source to sanitize the air, and push the sanitized air out of the outlet of the housing into the environment; and a cover plate disposed on the outlet of the housing, the cover plate configured to define a portion of the floor and including a grate configured to allow the air to exit the outlet of the housing into the environment.

2. The raised floor system of claim 1, wherein the floor is configured to support floor loads from about 10 pounds per square foot (lbs/ft$^2$) to 50,000 lbs/ft$^2$.

3. The raised floor system of claim 1, wherein the plurality of base units and the at least one sanitizer unit are spaced-apart to define channels therebetween.

4. The raised floor system of claim 3, further including a channel plate configured to cover at least one of the channels, the channel plates supported by the plurality of base units or the at least one sanitizer unit.

5. The raised floor system of claim 1, wherein the at least one sanitizer unit and plurality of base units are configured to be modularly re-arranged between a first configuration and a second configuration.

6. The raised floor system of claim 1, wherein the cover plate of the at least one sanitizer unit cooperates with the plurality of base units to define an approximately level plane along top surfaces thereof.

7. The raised floor system of claim 1, wherein the ultraviolet light source includes an ultraviolet bulb or an ultraviolet light emitting diode.

8. A raised floor system, comprising:

a plurality of pedestals;

a plurality of floor tiles, wherein each floor tile is supported by at least one pedestal of the plurality of pedestals, the plurality of floor tiles defining a raised floor dividing a volume into a plenum below the raised floor and an environment above the raised floor; and at least one sanitizer unit configured to provide sanitized air to the environment, the at least one sanitizer unit including:

a housing defining an inlet disposed within and open to the plenum and an outlet disposed substantially level with the raised floor and open to the environment;

an ultraviolet light source disposed in the housing between the inlet and outlet of the housing;

a fan configured to draw air from the plenum through the inlet of the housing into the housing, move the air across the ultraviolet light source to sanitize the air, and push the sanitized air out of the outlet of the housing into the environment; and an end plate disposed on the outlet of the housing, the end plate configured to allow the air to exit the outlet of the housing into the environment;

wherein a floor tile of the plurality of floor tiles receives the at least one sanitizer unit therethrough such that the end plate of the at least one sanitizer unit is approximately level with a top of the floor tile.

9. The raised floor system of claim 8, wherein the floor is configured to support floor loads from about 10 $lbs/ft^2$ to 50,000 $lbs/ft^2$.

10. The raised floor system of claim 8, wherein the plurality of pedestals, the plurality of floor tiles, and the at least one sanitizer unit are configured to be modularly re-arranged between a first configuration and a second configuration.

11. The raised floor system of claim 8, wherein the housing of the at least one sanitizer unit includes the inlet along a bottom portion of the housing to permit air flowing in the plenum to enter the at least one sanitizer unit, flow through the housing of the at least one sanitizer unit, and exit out the end plate of the at least one sanitizer unit.

12. The raised floor system of claim 8, wherein the housing is a hollow tube, the ultraviolet light source is oriented vertically within the hollow tube, and the fan is coupled to an end of the hollow tube.

* * * * *